United States Patent [19]

Gooding

[11] Patent Number: 4,566,137

[45] Date of Patent: Jan. 28, 1986

[54] INFLATABLE BAFFLED LINER FOR PROTECTIVE HEADGEAR AND OTHER PROTECTIVE EQUIPMENT

[76] Inventor: Elwyn R. Gooding, 2989 W. North Territorial Rd., Ann Arbor, Mich. 48105

[21] Appl. No.: 572,529

[22] Filed: Jan. 20, 1984

[51] Int. Cl.[4] ..... A42B 3/00

[52] U.S. Cl. ..... 2/413; 2/2; 2/425

[58] Field of Search ..... 2/413, 410, 411, 412, 2/414, 415, 425, 16, 22, 2, 6

[56] References Cited

U.S. PATENT DOCUMENTS

| | | | |
|---|---|---|---|
| 3,487,417 | 12/1969 | Morgan | 2/413 |
| 4,023,213 | 5/1977 | Rovani | 2/413 |
| 4,038,700 | 8/1977 | Gyory | 2/413 |
| 4,354,284 | 10/1982 | Gooding | 2/413 |
| 4,370,754 | 2/1983 | Donzis | 2/16 X |

*Primary Examiner*—Peter Nerbun

*Attorney, Agent, or Firm*—Norvell E. Von Behren

[57] ABSTRACT

A thin-profile multi-compartmented inflatable liner for use as an energy-absorbing device inside a protective headgear or other protective equipment. The multiple air compartments with integral intercommunicating air channels are formed of flexible plastic sheets which are dielectrically heat bonded together. The air compartments have within, resilient foam plastic co-acting bafflements with integral protrusions which interact with the intercommunicating air channels to thereby control the rate of air flow between the air compartments in response to an impact compression of the air compartments. The unique construction provides a thin-profile, light weight, high-energy absorbing liner with strength, durability and reliability to a high degree.

25 Claims, 27 Drawing Figures

Fig.12
Fig.13
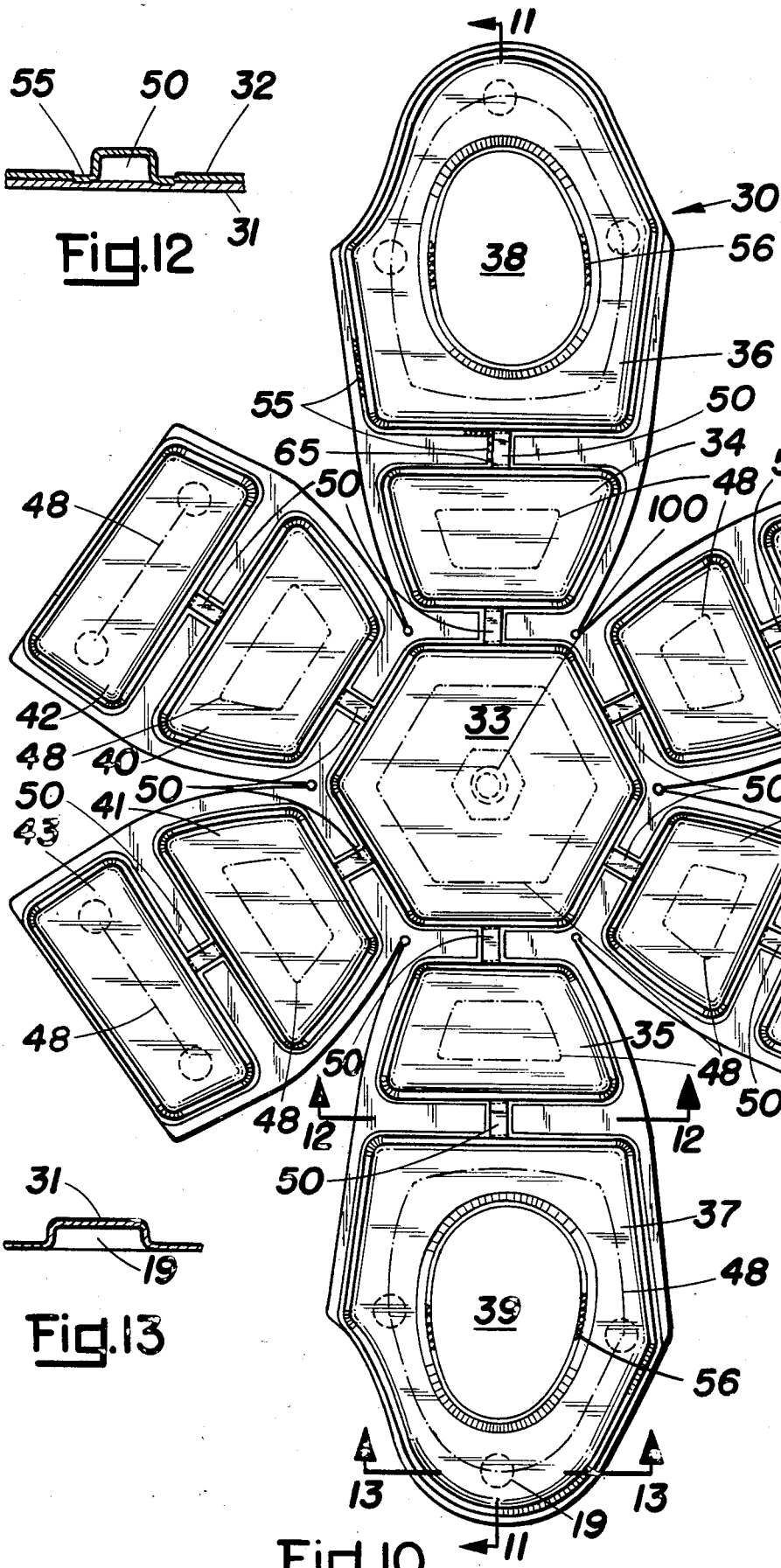
Fig.10
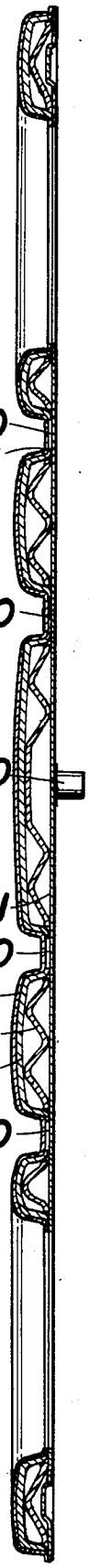
Fig.11

INFLATABLE BAFFLED LINER FOR PROTECTIVE HEADGEAR AND OTHER PROTECTIVE EQUIPMENT

BACKGROUND OF THE INVENTION

The present invention relates to protective equipment, and, more particularly to liners for protective headgear and other protective equipment.

There have been many kinds of inflated liners for head protection helmets with pre-formed chambers or compartments interconnected by small air passages. In some instances foam plastic pads of combinations of densities have been enclosed within the compartments to assist in attenuating the force of an impact to the helmet when worn.

In other designs, means to regulate the flow of air between the chambers have been employed, such as, the size of the intercommunicating orifice, valves and plastic plugs with filters.

The above concepts are shown and described in U.S. Pat. Nos.: to Nichols 2,664,567; to Simpson 3,039,109; to Cade 3,600,714; to Morgan 3,609,764; to Dunning 3,761,959; to Larcer 3,787,893; to Rovani 4,023,213; to Gyory 4,038,700; to Schulz 3,287,613; and to Gooding 4,375,108.

The prior art types of shock-absorbing headgear inflatable liners with multiple compartments have been only partially effective. The types with layers of resilient foam plastic within the compartments do not distribute the force of an impact to the helmet over a very large area of the head of the wearer. The types with only air within the multiple compartments have of necessity been very thick compartments so as not to "bottom-out," i.e. instantaneously be completely compressed, to thereby transmit a large portion of the force of the impact to the head of the wearer. The types with valves or inserts with filters to control the flow of air through the intercommunicating air channels have been quite complicated for manufacturing.

The unique construction of this invention provides an inflatable liner with a thin profile to attenuate the force of an impact over as large an area as possible and the longest period of time with strength, durability and reliability to a high degree, together with inexpensiveness of construction.

SUMMARY OF THE INVENTION

The present invention provides an inflatable impact attenuating liner for protective headgear and other protective equipment comprising a plurality of preformed compartments with co-acting bafflements which regulate the outward flow of air to adjacent compartments through interaction of integral protrusions at the entrances of intercommunicating air channels in response to a sudden compression of a compartment.

Another object of the invention is to provide alternate bafflement means to control the flow of air from an air compartment in response to a sudden compression of the compartment.

A further object of this invention is to provide a means whereby two liners having different co-acting bafflements may be stacked one atop the other to attain optimum attenuation of an impact force to the head and brain of the wearer of a protective helmet in which the liners are used.

A still further object of the invention is to provide a single stage bafflement means to control the rate of flow of air from an air compartment in response to a sudden compression of the compartment.

Yet another object and advantage of the invention is to provide a new and novel bafflement means to control air flow in an air compartment of a liner used with protective headgear such as football helmets.

Still another object and advantage of the invention is to provide an improved protective baffled liner for use with various equipment such as hockey equipment, space equipment, body protective pads and other applications.

Other objects, features and advantages of the invention will be readily apparent from the following description of the preferred embodiments thereof, taken in conjunction with the accompanying drawings in which like reference numerals are used to indicate like components in the various views.

BRIEF DESCRIPTION OF THE DRAWINGS

FIG. 10 is a top plan of the multi-air compartments with bafflements and integral intercommunicating air channels of the liner with preferred embodiments of the invention. The liner is shown removed from the helmet shown in FIGS. 1–6.

FIG. 11 is a cross-sectional view taken along line 11—11 of FIG. 10 showing the bafflements and inflation valve means.

FIG. 12 is an enlarged partial cross-sectional view of an intercommunicating air channel taken along line 12—12 of FIG. 10.

FIG. 13 is an enlarged partial cross-sectional view of a recess for attachment of a VELCRO disc taken along line 13—13 of FIG. 10.

relationship of the air compartment bafflements to the intercommunicating air channel.

Figure 14:
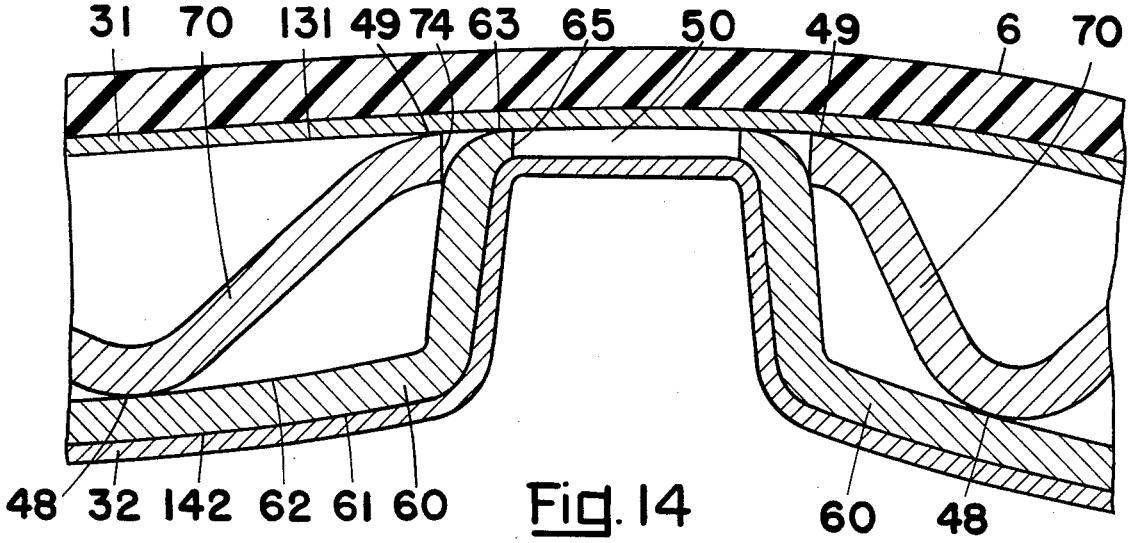
FIG. 14 is a greatly enlarged partial cross-sectional view taken along the center-line of the intercommunicating air channels 50 of FIG. 11 adjacent air compartments of the liner of the invention showing the "at-rest"
Figure 15:
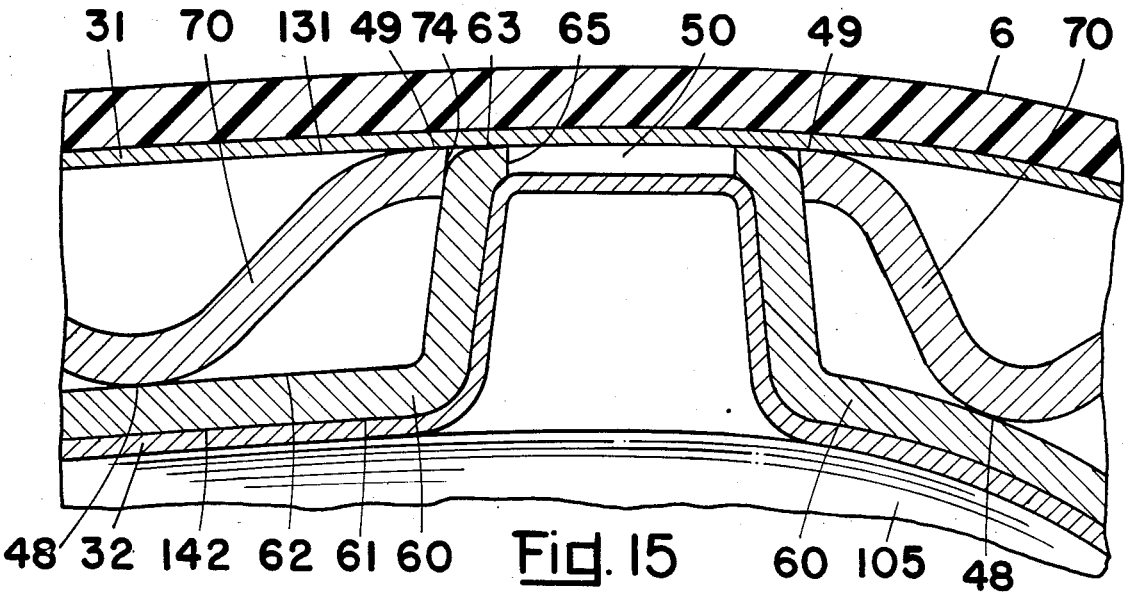

FIG. 15 is the same cross-sectional view as FIG. 14 showing the relationship of the air compartment bafflements to the intercommunicating air channel when the protective helmet is properly fitted to a person's head.

Figure 16:
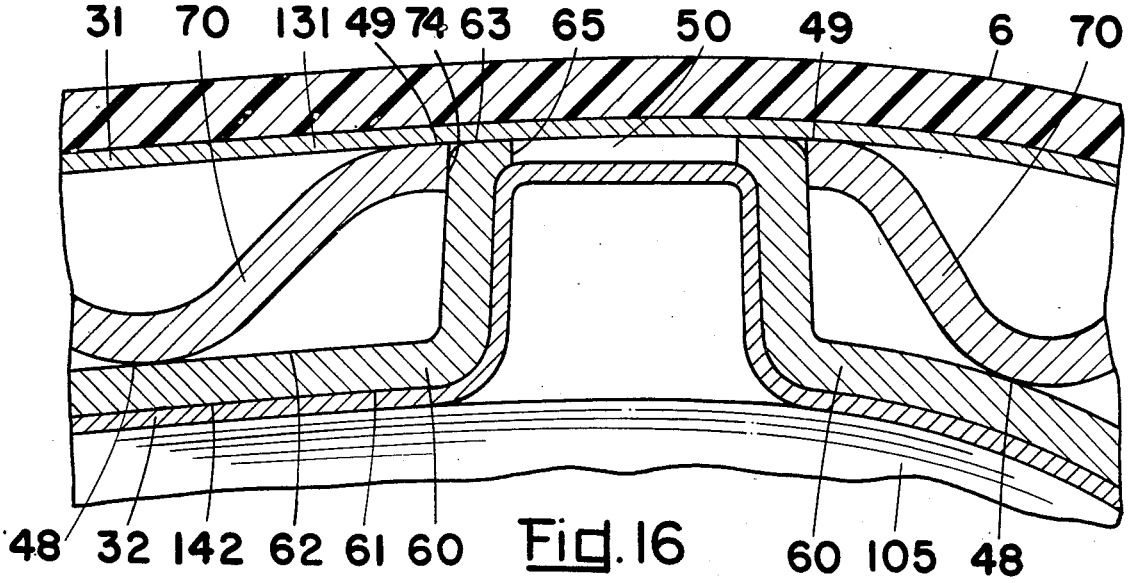

FIG. 16 is the same cross-sectional view as FIG. 15 showing the relationship of the air compartment bafflements to the intercommunicating air channel when the wearer's head decelerates into the liner at the time of an impact.

Figure 17:
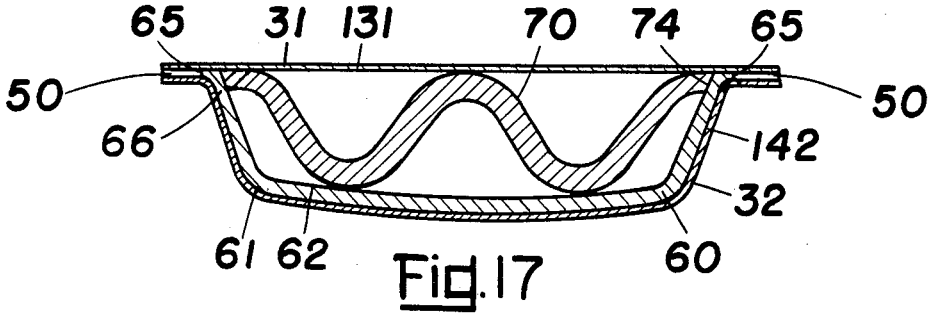

FIG. 17 is an enlarged cross-sectional view taken along the centerline of a typical air compartment with intercommunicating air channels to adjacent air compartments illustrating modified construction of the co-acting outer and inner bafflements.

Figure 1:
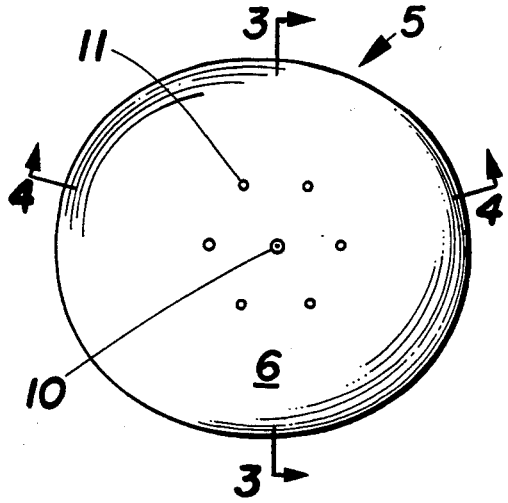
FIG. 1 is a top plan of the protective helmet incorporating the liner of the invention.
Figure 2:
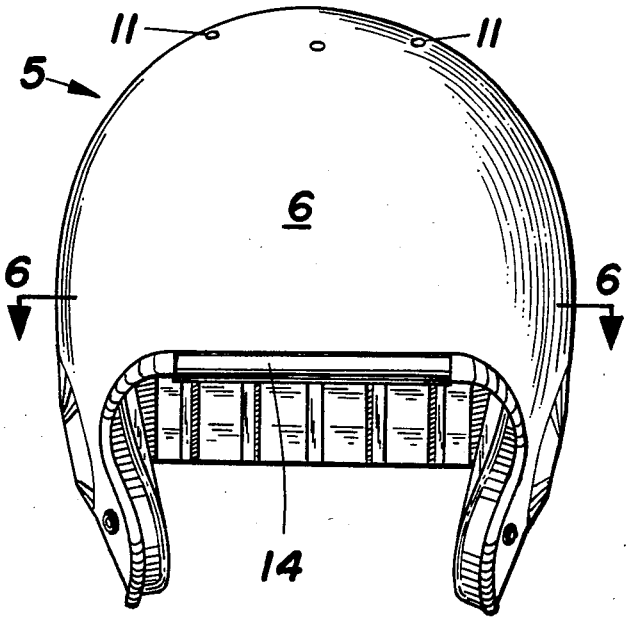
FIG. 2 is a front elevation view of the protective helmet with the chip cup/strap removed.
Figure 3:
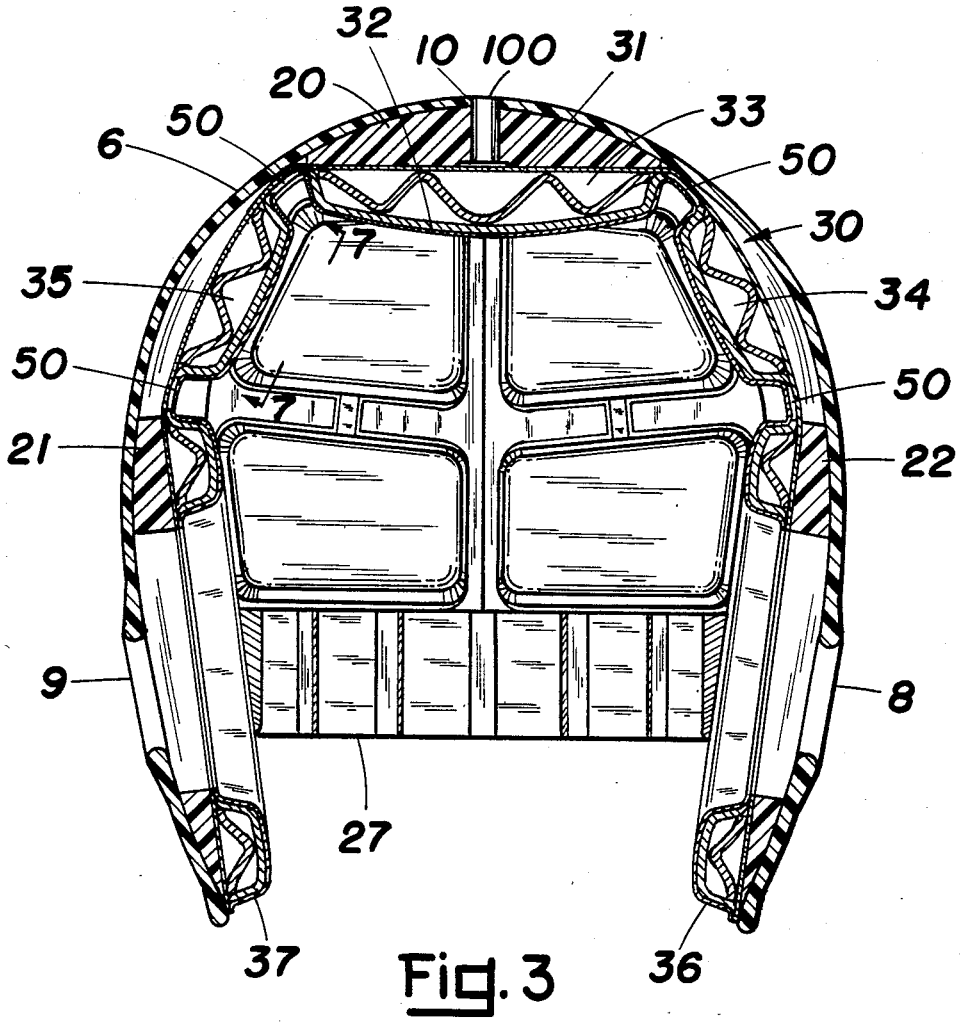
FIG. 3 is an enlarged cross-sectional view taken along line 3—3 of FIG. 1 illustrating the preferred embodiments incorporated in the liner of the invention shown assembled in the protective helmet.
Figure 4:
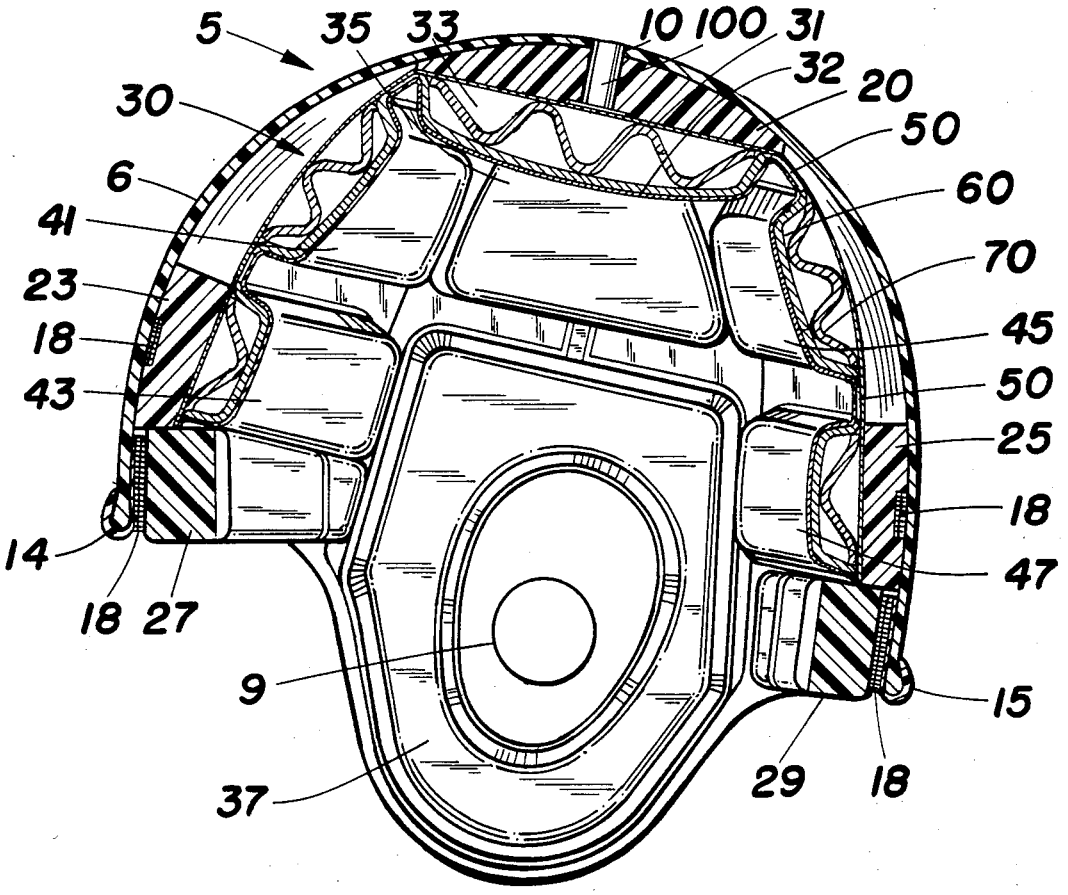
FIG. 4 is an enlarged cross-sectional view taken along line 4—4 of FIG. 1 showing the preferred form of the liner assembled in the protective helmet.
Figure 5:
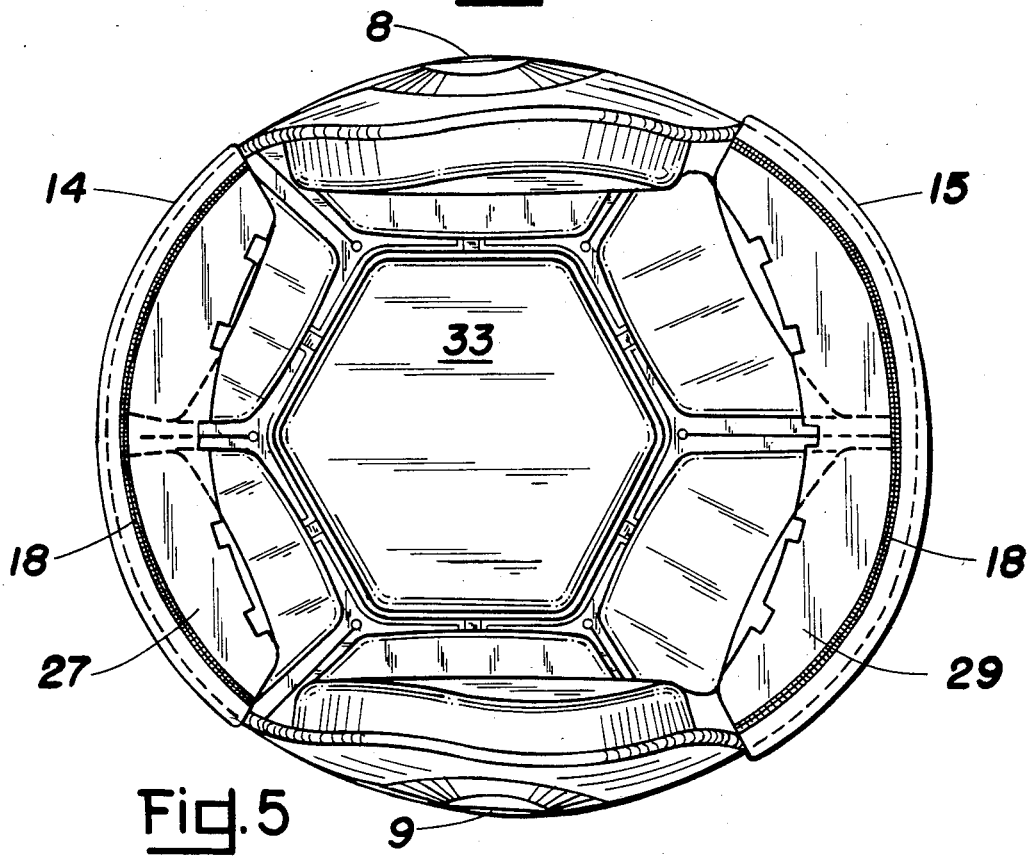
FIG. 5 is a bottom plan of the protective helmet with the liner of the invention assembled therein.
Figure 18:
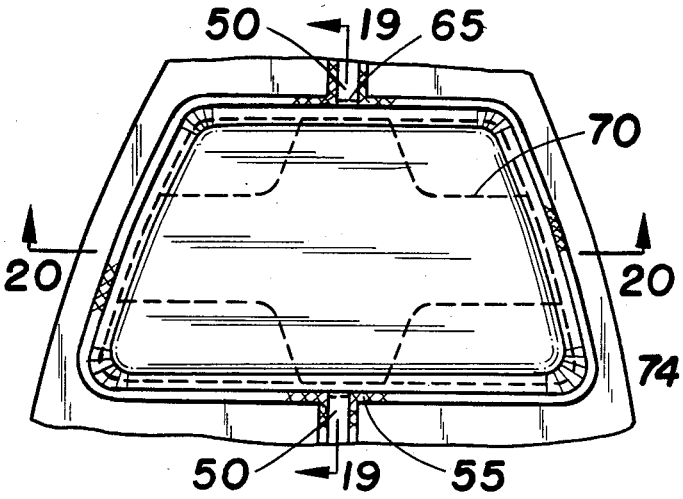

FIG. 18 is a plan taken along line 7—7 of FIG. 3 of a typical trapazoidal shaped air compartment with another modified construction of the inner bafflement.

Figure 19:
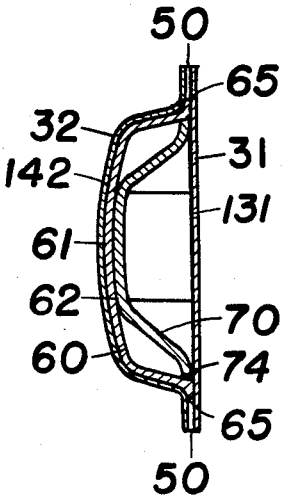

FIG. 19 is a cross-sectional view taken along line 19—19 of FIG. 18.

Figure 20:
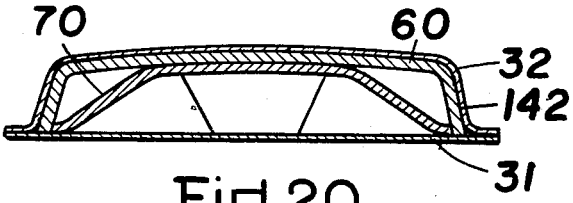

FIG. 20 is a cross-sectional view taken along line 20—20 of FIG. 18.

Figure 6:
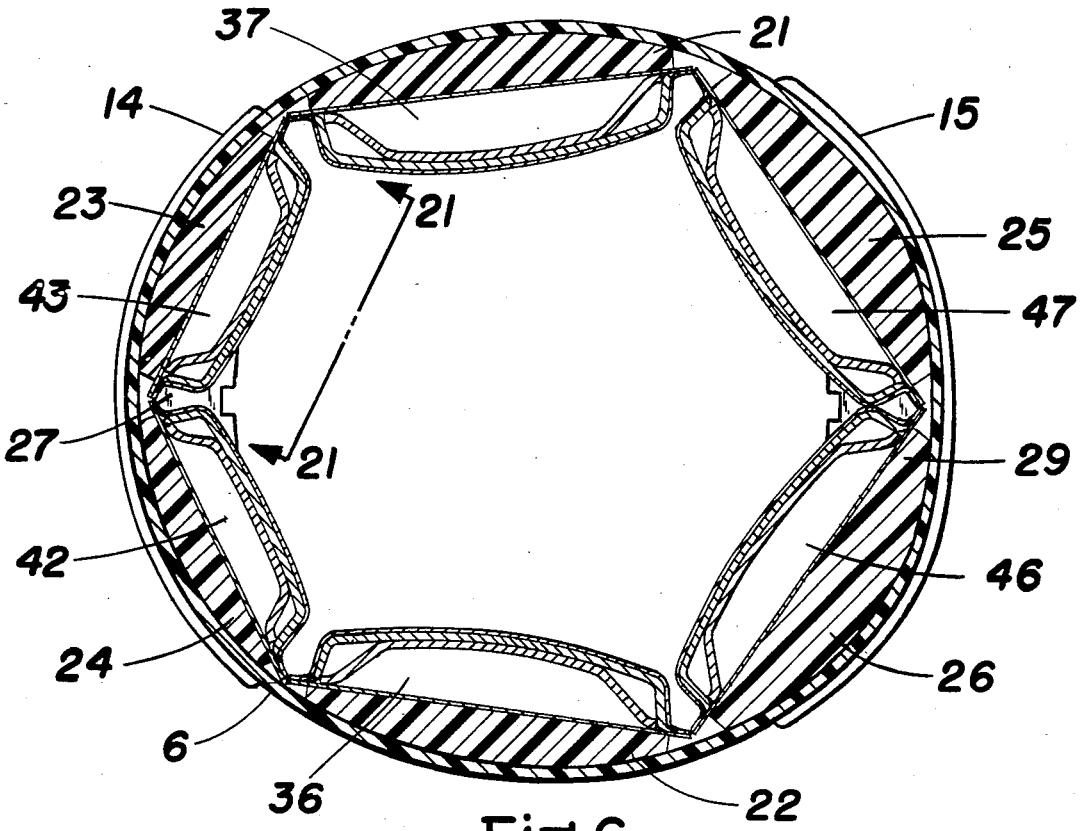
FIG. 6 is an enlarged cross-sectional view taken along line 6—6 of FIG. 2 showing sizing cushions and the liner assembled in the protective helmet.
Figure 21:
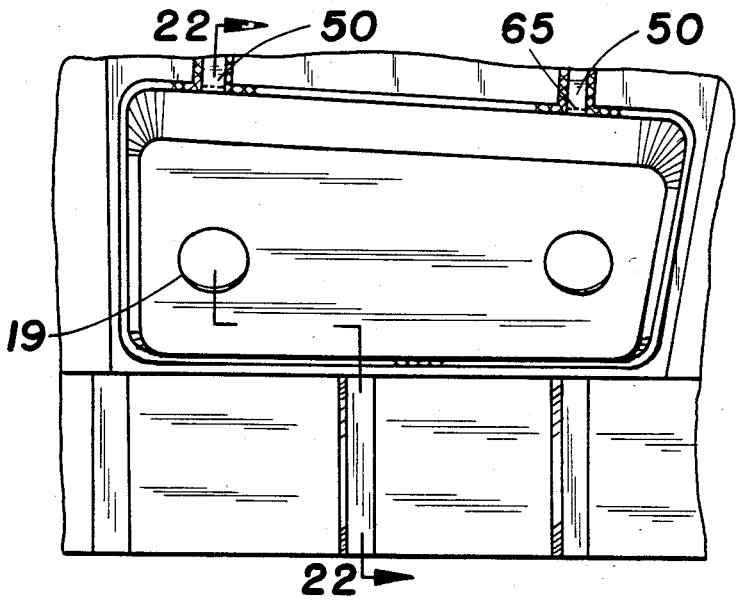

FIG. 21 is a fragmentary front elevation view taken along line 21—21 of FIG. 6 of an air compartment as it might be assembled in a helmet illustrating a means for stacking two independent liners.

Figure 22:
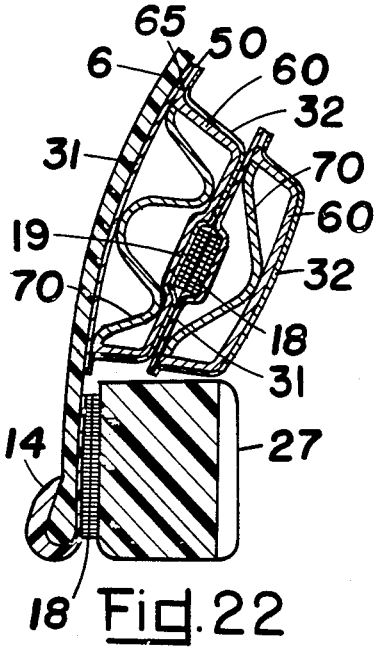

FIG. 22 is a partial cross-sectional view taken along line 22—22 of FIG. 21 with a second independent liner stacked in front of the liner shown in FIG. 21.

Figure 23:
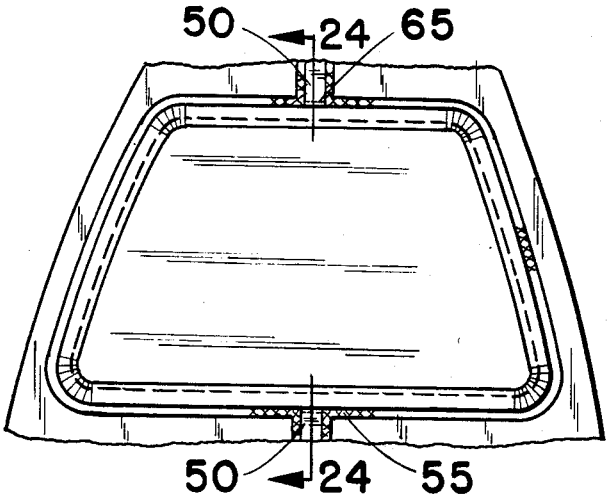

FIG. 23 is a top plan taken along line 7—7 of FIG. 3 of a modified typical trapazoidal shaped air compartment with a single stage bafflement.

Figure 24:
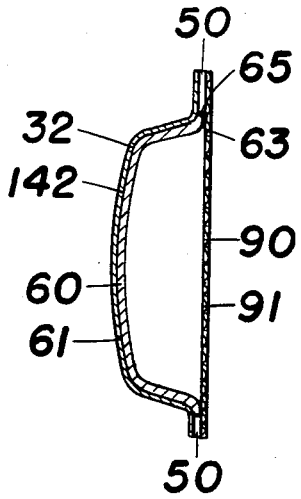

FIG. 24 is a cross-sectional view taken along line 24—24 of FIG. 23 showing a single stage bafflement and relationship to intercommunicating air channels.

Figure 25:
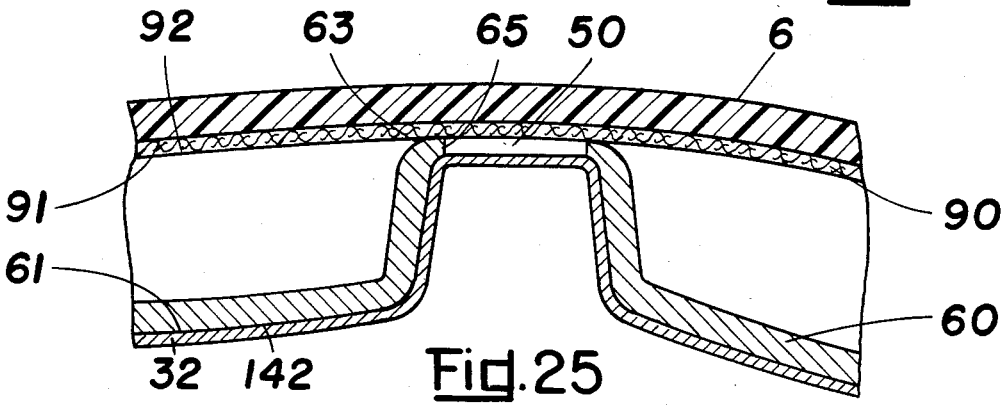

FIG. 25 is a greatly enlarged partial cross-sectional view, similar to FIG. 14, taken along the center-line of the intercommunicating air channels between the adjacent air compartments of the modified liner of the invention showing the "at-rest" relationship of the air compartments with single stage bafflements to the intercommunicating air channel.

Figure 26:
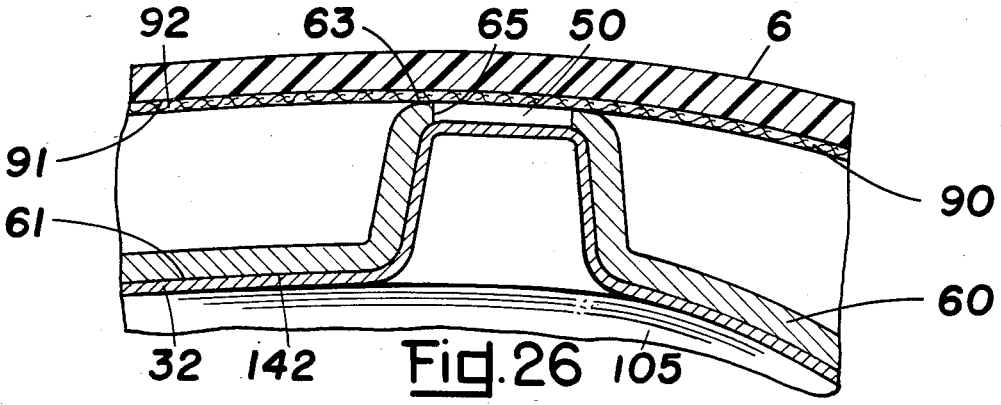

FIG. 26 is the same cross-sectional view as FIG. 25, similar to FIG. 15, showing the relationship of the air compartments with modified single stage bafflements to the intercommunicating air channel when the protective helmet is properly fitted to a person's head.

Figure 27:
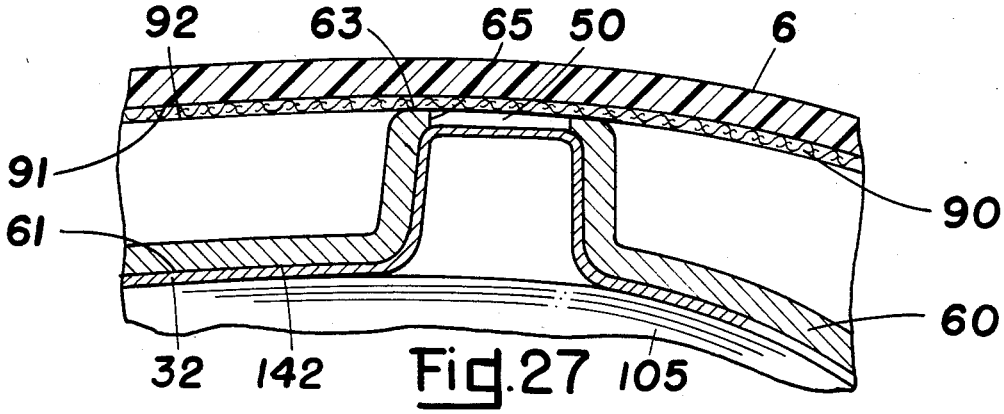

FIG. 27 is the same cross-sectional view as FIG. 26, similar to FIG. 16, showing the relationship of the air compartments with modified single stage bafflements to the intercommunicating air channel when the wearer's head decelerates into the liner at the time of an impact.

DESCRIPTION OF THE PREFERRED EMBODIMENTS

Referring now to FIGS. 1–6, reference numeral 5 indicates generally a football helmet of type which has a liner that incorporates the improvements of the invention. The helmet includes a shell 6 composed of a high impact-resistant plastic resin such as ABS (acrylonitrile-butadine-styrene) or polycarbonate. It has a front edge bumper 14 of a resilient material as synthetic rubber or polyurethane and a neck bumper 15 of similar material secured to the back edge. Ear holes 8 and 9 are provided on the sides of the helmet, a liner inflation valve hole 10 and ventilation holes 11 are in the crown portion.

To assist in fitting a helmet with the liner of this invention, sizing cushions 20–26 of a resilient foam plastic are positioned between the inside of the outer shell and the liner. The sizing cushions are attached to the outer shell with releasable fabric fastening strips commercially sold under the trade name VELCRO as disclosed in prior U.S. Pat. Nos. 2,717,437, 3,009,235, 3,083,737 and 3,154,837. The sizing cushions 20–26 have recesses to accommodate the VELCRO 18 so that the sizing cushions 20–26 fit in surface-to-surface contact with the inside surface of the outer shell 6 and the inner liner 30 fits in surface-to-surface contact with the inner surfaces of the sizing cushions 20–26. In a similar way of mounting, a larger sizing cushion 27 is used at the front of the helmet 5 for the forehead area of the wearer and another large sizing cushion 29 is used at the back of the helmet 5 for the occiput of the wearer. The combination of sizing cushions and proper inflation of the liner will provide a very wide range of sizes and shapes of heads of wearers of the helmet.

Figure 7:
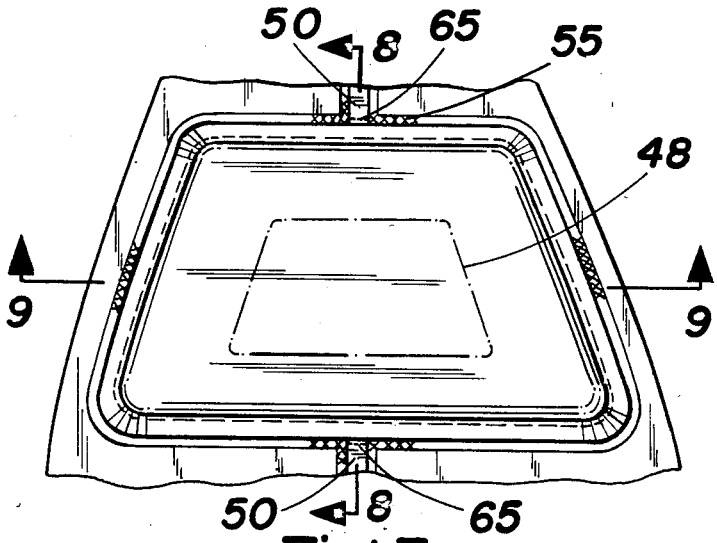
FIG. 7 is a top plan taken along line 7—7 of FIG. 3 of a typical trapazoidal shaped air compartment with co-acting outer and inner bafflements.
Figure 8:
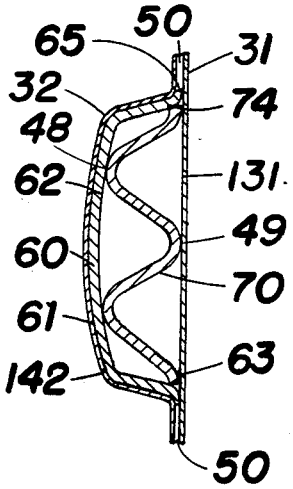
FIG. 8 is a cross-sectional view taken along line 8—8 of FIG. 7 showing an air compartment with outer and inner bafflements and their relationship to each other and to the intercommunicating air channels to adjacent air compartments.
Figure 9:
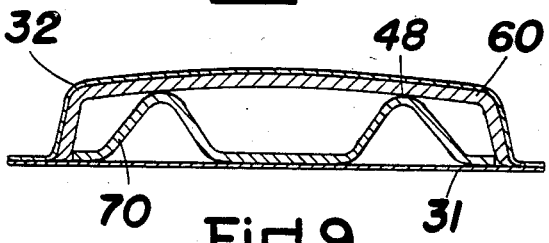
FIG. 9 is a cross-sectional view taken along line 9—9 of FIG. 7 showing the relationship of the outer bafflement, convoluted inner bafflement, the pre-formed air compartment and the bottom panel of the air compartment.

Shown in FIG. 7 is a top plan taken along line 7—7 of FIG. 3 at a typical trapazoidal shaped air compartment of the liner of the invention generally indicated by reference numeral 30 in FIGS. 3 and 10. An air compartment and components, shown in cross-sectional views in FIGS. 8 and 9 include a bottom panel 31, a pre-formed top panel 32 with integral formed intercommunicating air channels 50, with an outer bafflement 60 and inner bafflement 70 positioned between the panels. The top panel 32 and bottom panel 31 are heat bonded together around the perimeter of the pre-formed air compartment in the area generally indicated by the numeral 55 leaving only the intercommunicating air channel 50 areas unbonded. The outer bafflement 60 is thermoformed of resilient foam cross-linked polyethylene. It is dimensioned and trimmed so that the outer surface 61 is in surface-to-surface contact with the inner surface 142 of the pre-formed top panel 32 of the air compartment with integral formed small protrusions 65 at the entrances to the corresponding intercommunicating air channels 50. The small protrusions 65 are compressed to the proper thickness during the thermoforming operation and sized to width and length during the trimming operation so that they will match the size of the intercommunicating air channels 50. The inner bafflements generally indicated by reference numeral 70 are thermoformed of the same material as the outer bafflements 60 and have convolutions which are generally parallel to the contour of the outer bafflement. The reference numeral 48 in FIGS. 7 and 10 generally indicates the top plan of the apexes of the convolutions of the various inner bafflements 70 which apex surfaces are in surface-to-surface contact with the inner surfaces 62 of the outer bafflements 60.

Referring now to FIGS. 10–13, shown is the liner 30 removed from the helmet 5. The liner 30 consists of a plurality of pre-formed air compartments 33, 34, 35, 36, 37, 40, 41, 42, 43, 44, 45, 46 and 47 with co-acting bafflements 60 and 70 and have intercommunicating air channels 50 between the air compartments. At the center of the liner is a hexagon shaped thermoformed air compartment 33 in the top panel 32 and an inflating valve means 100 heat bonded at the center of the bottom panel 31. There are three sets-of-two compartments 34/36, 40/42, 44/46 arranged angulately to three sides of the central hexagon-shaped air compartment 33 and three set-of-two air compartments 35/37, 41/43, 45/47 arranged angulately in a mirror image to the opposite three sides of the hexagon shaped air compartment 33. The outermost air compartments 36 and 37 have clearance flange areas 56 shown cross hatched are heat bonded as are the areas around all of the air compartments generally indicated by the numeral 55, leaving only the intercommunicating air channels 50 unbonded. The relationship of the bafflements to the intercommunicating air channels 50 is the same in all air compartments. The outside perimeter of the liner 30 and the inside perimter of the ear clearance openings 38 and 39 are heat bonded and steel rule die trimmed to the desired contour. FIG. 11, which is a cross-sectional view of the liner taken along line 11—11 of FIG. 10, shows the relationship of the pre-formed top panel 32 of the air compartments, the outer bafflements 60, inner bafflements 70, intercommunicating air channels 50, and the bottom panel 31 of the air compartments with integral bonded liner inflation valve means 100 at the center. All air compartments are inflated through the single valve means 100. When assembled in the outer shell 6, the inflation valve means 100 is positioned in the hole 10 in the crown section. This permits the liner 30 to be inflated as desired from the outside of the helmet. A typical intercommunicating air channel 50 is shown in enlarged cross-section in FIG. 12. A typical recess for VELCRO 18 for attaching the liner to the sizing pads or in some instances to the inside surface of the helmet shell 6 is shown in enlarged cross-section in FIG. 13.

The method whereby the outer bafflements 60 and inner bafflements 70 co-act to control the flow of air through the intercommunicating air channels 50 is more readily understood by the explanations of FIGS. 14, 15 and 16 which illustrate the relationship of these components "at-rest," i.e. with the liner partially inflated prior to the helmet being positioned on the wearer's head, when properly inflated and positioned on head, and upon an impact respectively. Referring now to FIG. 14, the greatly enlarged cross-sectional view is taken along the centerline of the intercommunicating air channel 50 between adjacent air compartments of FIG. 11 to illustrate the relationship of the air compartments, the inner bafflement 70, and the outer bafflement 60 with integral protrusion 65 to the corresponding intercommunicating air channel 50. When properly inflated the air pressure within all of the air compartments will be the same and all of the surfaces will be slightly convex. The outer surface 61 of the outer bafflement 60 will be in surface-to-surface contact with the inner surface 142 of the top panel 32 of the air compartment and the surface 63 of the outer bafflement 60 will be in surface-to-surface contact with the inner surface 131 of the bottom panel 31 of the air compartment. The protrusions 65 on the outer bafflement 60 will be at the entrances of the corresponding intercommunicating air channels 50. The apex surface 48 of the convolutions of the inner bafflement 70 will be in surface-to-surface contact with the inner surface 62 of the outer bafflement 60 with the apex surfaces 49 of the reverse convolutions in surface-to-surface contact with the inner surface 131 of the bottom panel 31 of the air compartment. The peripheral edge surface 74 of the inner bafflement 70 will be in surface-to-surface contact with the inner surface 62 of the outer bafflement 60.

With the helmet properly fitted to the head of a wearer as illustrated in FIG. 15, the outside surface of the wearer's head 105 compresses the air compartments so that the top panel 32 of the air compartment and the outer bafflement 60 are now slightly concave. The pressure within all air compartments will be the same with but slight pressure of the protrusion 65 against the end of the intercommunicating air channel 50. The inner bafflement 70 is compressed slightly with the resultant radially outward edgewise movement of the peripheral surface 74 against the inner surface 62 of the sidewall of the outer bafflement 60 whose surface 63 has been pressed more firmly against the inner surface 131 of the bottom panel 31 of the air compartment. As a result, the protrusion 65 of the outer bafflement 60 is pressed more firmly into the end of the intercommunicating air channel 50 thereby creating a greater resistance to the flow of air through the channel at the time of impact to the helmet.

Upon an impact to the outer shell 6 as illustrated in FIG. 16, there will be an additional compression of the sidewalls of the outer bafflement 60, pressing the surface 63 more firmly against the inner surface 131 of the bottom panel 31 of the air compartment. There will be additional compression of the air compartment top panel 32 and both the outer 60 and inner 70 bafflements with resultant outward edgewise movement of the peripheral surface 74 thereby pressing the protrusion 65 more firmly into the end of the intercommunicating air channel 50 thus controlling the rate of flow of air from the air compartment opposite the site of the impact. Inasmuch as all components of the liner are resilient, there will always be a flow of air through the intercommunicating air channels 50 from the air compartments with the greatest internal pressure toward the air compartments with less internal pressure. However, the rate of flow will be regulated by the afore described co-acting bafflements 60 and 70 with integral air channel 50 engaging protrusion 65. Thus the force of an impact is attenuated and distributed over a very large area of the head of the wearer and the time to complete deceleration in the given distance is greatly increased through the embodiments of the co-acting bafflements 60 and 70 within the air compartments and interaction of the protrusions 65 with the corresponding intercommunicating air channels 50.

Illustrated in FIG. 17 are modifications which will enhance the control of the outward flow of air from an air compartment upon impact. The outer bafflement 60 and inne bafflement 70 are pre-molded to more precise configurations and dimensions to effect a more efficient control of the rate of flow of air through the intercommunicating air channel 50. The side walls of the outer bafflement 60 are tapered with the edge portion 66 thinner than the main portion so that it will flex edgewise more easily. The inner bafflement 70 has the outer walls of the convolutions tapered as shown with the peripheral edge portion 74 being thinner than the main portion so as to exert a greater localized edgewise pressure at the end of the intercommunicating air channel 50 when the pre-formed air compartment is compressed toward the outer shell.

Referring now to FIGS. 18, 19 and 20, shown is a typical trapazoidal shaped air compartment taken along line 7—7 of FIG. 3 illustrating another set of bafflements that can be used for special applications. This type of bafflement could be used in combination with other bafflements when two liners are arranged in a tier as illustrated in FIG. 22. In some instances it may be desirable to use two liners with air compartments with different outer 60 and inner bafflement 70 configurations to accomplish attenuation of impact forces of various degrees. In some applications it may be desirable to have the bafflements within the pre-formed air compartments of the liner next to the outer shell quite firm to thereby respond to a very high mass-high velocity impact at the onset and have bafflements within the liner next to the wearer's head somewhat softer to thereby further attenuate and redistribute the force of the impact over a much greater area of the head and in a longer period of time. The two liners could be readily stacked or tiered as illustrated in FIGS. 21 and 22 using releasable VELCRO 18. Matching recesses 19 of the type shown in FIG. 13 to accommodate the VELCRO 18 would be provided in the innermost surface of the liner adjacent the shell and on the outermost surface of the inner liner.

Referring to FIGS. 23 and 24, shown is a typical trapazoidal shaped air compartment taken along line 7—7 of FIG. 3 of an alternate construction with a single stage bafflement as used in a liner 30. In the modification as shown in FIGS. 23–27, the inner bafflement 70 has been eliminated and the applicant's device functions with the outer bafflement 60 as hereinafter modified. The bottom panel 90 of the air compartment consists of a fine weave fabric which has been coated to be impervious to air and be dielectrically heat bonded to the pre-formed air compartment flexible plastic top panel 32. When the fabric bottom panel 90 is coated it becomes firmer but remains flexible. The modified single stage outer bafflement 60 is the same shape as the pre-formed cavity in top panel 32 but is purposely formed slightly oversize except the protrusions 65 which are sized to the dimensions of the corresponding intercommunicating air channels 50. The outer surface 61 of bafflement 60 is therefore in tight surface-to-surface contact with the inner surface 142 of the top panel 32 of the pre-formed air compartment and perimeter surface 63 is in tight surface-to-surface contact to the inner surface 91 of the bottom panel 90. The integral protrusions 65 of bafflement 60 extend slightly into the intercommunicating air channels 50.

The method whereby the single stage bafflement 60 responds to an impact to an air compartment to control the rate of flow of air through the intercommunicating air channel 50 is more readily understood by the explanations of FIGS. 25, 26 and 27. Referring to FIG. 25, similar to FIG. 14, the greatly enlarged cross-sectional view is taken along the centerline of the intercommunicating air channel 50 between adjacent air compartments to illustrate the relationship of the air compartment, the single stage bafflement 60 with integral protrusion 65 to the intercommunicating air channel 50 when the liner is partially inflated prior to the helmet being positioned on the wearer's head. In this "at-rest" state and properly inflated, the surfaces of the top panel 32 of the air compartments and single stage bafflements 60 are slightly convex. The relationship of the surfaces of the bafflements 60 to the pre-formed air compartments will be as afore described. When positioned on the wearer's head and properly inflated as illustrated in FIG. 26, similar to FIG. 15, the air compartments will be slightly compressed so that the surfaces of the top panel 32 in contact with the wearer's head 105 will be slightly concave. The side walls of bafflement 60 will compress very little so that there will be but slight pressure of protrusion 65 into the end of the intercommunicating air channel 50.

As illustrated in FIG. 27, similar to FIG. 16, with an impact to the outer shell 6, the head 105 of the wearer compresses the air compartment more. There will be a resultant greater pressure of the protrusion 65 into the end of the intercommunicating air channel 50 due to the edgewise outward movement of the protrusion 65 as the side walls of the single stage bafflement 60 are compressed. Thus the rate of flow of air through the intercommunicating air channel is controlled by the pressure of the integral protrustion 65 into the end of the intercommunicating air channel 50. However, as all of the components are resilient there will always be a flow of air from the air compartment with the greatest pressure to the air compartment with less pressure. After the impact, the air compartment with the single stage bafflement 60 will return to its previous configuration. This construction permits repeated impacts at very short intervals as restitution is almost instantaneous.

The applicant's new and novel invention may be used with an inner bafflement 70 and an outer bafflement 60 which may be used singly or stacked as shown in FIGS. 21 and 22. The inner bafflement 70 may be eliminated and the outer bafflement 60 used by itself as shown and described when referring to FIGS. 23–27 of the drawings.

The above described liners by their unique construction lend themselves to be adapted to be used in every conceivable kind of protective headgear and other protective equipment where there is a need for maximum attenuation of the force of an impact utilizing a thin profile, light weight structure.

It may be used with inexpensive resilient foam plastic sizing pads in helmets to reduce the number of different outer shells to fit a greater span of head sizes.

It may be used in body protective pads to reduce bulkiness and weight of solid foam pads and increase protection for the area where used.

While the construction of the liner afore-described has particular application to football helmets, it is by no means limited thereto and helmets and other protective equipment incorporating the claimed design of the liner may be advantageously used in all kinds of activites where it is desirable to prevent injury by an impact.

From a study of the drawings and a reading of the specification, it is apparent that other changes may be made in the applicant's invention without departing from the spirit and scope of the invention. The applicant is not to be limited to the exact configuration shown and described which have been given by way of illustration only.

Having described my invention, I claim:

1. A liner for use in a protective helmet and other protective equipment, comprising:

(a) a first flexible plastic sheet;

(b) a second flexible plastic sheet fixedly attached to the first plastic sheet, the first and second attached sheets forming at least two spaced apart pre-formed air compartments with an integral pre-formed intercommunicating air channel therebetween;

(c) at least one resilient bafflement positioned within the air compartments and in contact with at least one of the plastic sheets, the bafflement having formed thereon sidewall edges with protrusions sized to engage open ends of the corresponding intercommunicating air channel; the two air compartments and the resilient bafflement continually co-acting to control a variable rate of flow between the compartments in direct response to varying forces of impact to the air compartment, the variable rate of flow being regulated by the movement of the resilient bafflement against the open ends of the intercommunicating air channel responsive to the impact forces; and (d) means, for inflating the two air compartments to a similar desired pressure, through the intercommunicating channel associated with one of the flexible sheets.

2. The liner as defined in claim 1 further comprising the first and second sheets being dielectrically heat bonded and the resilient bafflement is formed of foam plastic.

3. The liner as defined in claim 1 wherein the means for inflating comprises a resealable valve positioned in an opening formed in one of the flexible plastic sheets.

4. The liner as defined in claim 1 further comprising at least two liners similarly constructed positioned on top of each other and held together by attaching means to thereby provide increased protective padding.

5. The liner as defined in claim 1 further comprising at least six air compartments similarly constructed and integrally pre-formed with a central section formed from the first and second flexible sheets, the central section having one pre-formed air compartment and having six integral pre-formed intercommunicating air channels with the six air compartments.

6. The liner as defined in claim 5 wherein the inflating means comprises a resealable valve fixedly attached to the central section.

7. A protective equipment comprising the combination of:

(a) an outer covering;

(b) a liner fixedly attached to the inside of the outer covering, the liner comprising:

(1) a first flexible plastic sheet;

(2) a second flexible plastic sheet fixedly attached to the first plastic sheet, the first and second attached sheets forming at least two spaced apart pre-formed air compartments with an integral pre-formed intercommunicating air channel therebetween;

(3) at least one resilient bafflement positioned within the air compartments and in contact with at least one of the plastic sheets, the bafflement having formed thereon sidewall edges with protrusions sized to engage open ends of the corresponding intercommunicating air channel; the two air compartments and the resilient bafflement continually co-acting to control a variable rate of flow between the compartments in direct response to varying forces of impact to the air compartments, the variable rate of flow being regulated by the movement of the resilient bafflement against the open ends of the intercommunicating air channel responsive to the impact forces; and (4) means, for inflating the two air compartments to a similar desired pressure, through the intercommunicating air channel associated with one of the flexible sheets.

8. The protective equipment as defined in claim 7 wherein the outer covering is a football helmet.

9. The protective equipment as defined in claim 7 wherein the outer covering is a unit of sporting attire.

10. The protective equipment as defined in claim 7 wherein the outer covering is a space suit.

11. A liner for a protective helmet for activities such as football which comprises:

(a) a first flexible plastic sheet to which is dielectrically heat bonded to a second flexible plastic sheet with multiple pre-formed air compartments with integral pre-formed intercommunicating air channels;

(b) pre-formed resilient foam plastic outer bafflements with outer surfaces in surface-to-surface contact with the inner surfaces of the pre-formed air compartments of said second flexible plastic sheet;

(c) protrusions on sidewall edges of said outer bafflements and sized to engage open ends of corresponding said intercommunicating air channels of said second plastic sheet;

(d) pre-formed convolution resilient foam plastic inner bafflements positioned within aforesaid outer bafflements with apex surfaces of inward facing convolutions in surface-to-surface contact with inner surface of said outer bafflement, with apex surfaces of outward facing convolutions in surface-to-surface contact with the inner surface of said first flexible plastic sheet and with edge surfaces in juxtaposition to the sidewall inner edge surfaces of said outer bafflements; and (e) a resealable valve means, associated with the liner, for inflating the liner to desired pressure in said multiple pre-formed air compartments with aforesaid outer and inner bafflements through said intercommunicating air channels.

12. The liner as described in claim 11 in which the flexible plastic sheets of the multiple pre-formed air compartments are polyurethane.

13. The liner as described in claim 11 in which the flexible plastic sheets of the multiple pre-formed air compartments are PVC, polyvinylchloride.

14. The liner as described in claim 11 in which the outer and inner bafflements are of resilient cross-linked polyethylene foam plastic.

15. The liner as described in claim 14 in which the resilient cross-linked polyethylene foam plastic is of different densities in said outer and inner bafflements to attain optimum response to various anticipated impact forces.

16. The liner as described in claim 11 in which said bafflements of resilient foam plastic are geometrized to attain optimum control of the rate of flow of air through said intercommunicating air channels.

17. The liner as described in claim 11 in which said first and second flexible plastic sheets have specifically positioned recesses for mounting mutually releasable fabric fastener means for stacking one liner atop another liner.

18. The liner as described in claim 16 in which said bafflements in one liner are a different configuration to co-act with the bafflements in a second tiered liner to meet the anticipated impact force response requirements of specific applications.

19. The liner as described in claim 18 in which the density of said bafflements in the outer tiered liner is firmer than the density of said bafflements in the inner tiered liner to attain optimum response to anticipated forces of very high-mass high-velocity impacts.

20. The liner as described in claim 11 in which said multiple pre-formed air compartments are arranged with a mutual central air compartment and sets of at least two air compartments arranged angulately to the sides of the mutual central air compartment with integral intercommunicating air channels between adjacent air compartments.

21. A liner for protective headgear and other protective equipment comprising:

(a) a first panel of flexible fabric coated to be impervious to air and is dielectrically heat bonded to a second flexible plastic panel with multiple pre-formed air compartments with integral pre-formed intercommunicating air channels;

(b) pre-formed resilient foam plastic single state bafflements slightly oversize so that the outer surfaces are in tight surface-to-surface contact to the inner surfaces of the pre-formed air compartments of said second flexible plastic panel;

(c) protrusions on sidewall edges of said single stage bafflements and sized to engage open ends of corresponding said intercommunicating air channels of said second plastic panel; the two air compartments and the resilient bafflement continually co-acting to control a variable rate of flow between the compartments in direct response to varying forces of impact to the air compartments, the variable rate of flow being regulated by the movement of the resilient bafflement against the open ends of the intercommunicating air channel responsive to the impact forces; and (d) a resealable valve means for inflating the liner to desired pressure in said multiple pre-formed air compartments with aforesaid single stage bafflements through said intercommunicating air channels.

22. The liner as defined in claim 21 in which said first flexible panel of said multiple air compartments is Nylon.

23. The liner as defined in claim 21 in which said second flexible panel of said multiple pre-formed air compartments is flexible polyurethane.

24. The liner as defined in claim 21 in which said second flexible panel of said multiple pre-formed air compartments is flexible PVC, polyvinyl chloride.

25. The liner as defined in claim 21 in which said single stage bafflement is resilient cross linked polyethylene foam plastic.

* * * * *